US007717238B2

(12) United States Patent
Hamaji et al.

(10) Patent No.: US 7,717,238 B2
(45) Date of Patent: May 18, 2010

(54) ELEVATOR CONTROL SYSTEM

(75) Inventors: Hiroaki Hamaji, Tokyo (JP); Masaaki Amano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 478 days.

(21) Appl. No.: 11/722,720

(22) PCT Filed: Nov. 1, 2005

(86) PCT No.: PCT/JP2005/020078

§ 371 (c)(1),
(2), (4) Date: Jun. 25, 2007

(87) PCT Pub. No.: WO2007/052336

PCT Pub. Date: May 10, 2007

(65) Prior Publication Data

US 2009/0120727 A1 May 14, 2009

(51) Int. Cl.
*B66B 1/34* (2006.01)

(52) U.S. Cl. ..... 187/396; 187/392

(58) Field of Classification Search ..... 187/247, 187/248, 380–388, 391–396
See application file for complete search history.

(56) References Cited

U.S. PATENT DOCUMENTS 4,979,594 A * 12/1990 Begle et al. ..... 187/380
5,042,620 A * 8/1991 Yoneda et al. ..... 187/382
5,411,118 A * 5/1995 Thangavelu et al. ..... 187/392
6,202,799 B1 * 3/2001 Drop ..... 187/388
6,397,976 B1 * 6/2002 Hale et al. ..... 187/392
6,801,792 B1 * 10/2004 Schuster et al. ..... 455/566
6,945,365 B2 * 9/2005 Matela ..... 187/382
7,328,775 B2 * 2/2008 Zaharia et al. ..... 187/396
7,445,090 B2 * 11/2008 Bodmer et al. ..... 187/391
7,552,800 B2 * 6/2009 Puskala et al. ..... 187/384

FOREIGN PATENT DOCUMENTS

JP 6 72644 3/1994
JP 10 95575 4/1998
JP 2002 220177 8/2002

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

An elevator control system includes an entrance person authentication section provided at a predetermined distance from an elevator hall for permitting a visitor to use an elevator and register a call of the elevator. A storage section stores a predetermined estimated move time value for the visitor to move from the entrance person authentication section to the hall. An arrival detection section detects the elevator arriving at the hall. A timer starts to count based on permission of the entrance person authentication section and sets an arrival time value when the arrival detection section detects the elevator arriving at the hall. A display notifies a passenger in a car or at the hall of a presence of the visitor. If the arrival time value is shorter than the estimated move time value, the display is activated.

4 Claims, 5 Drawing Sheets

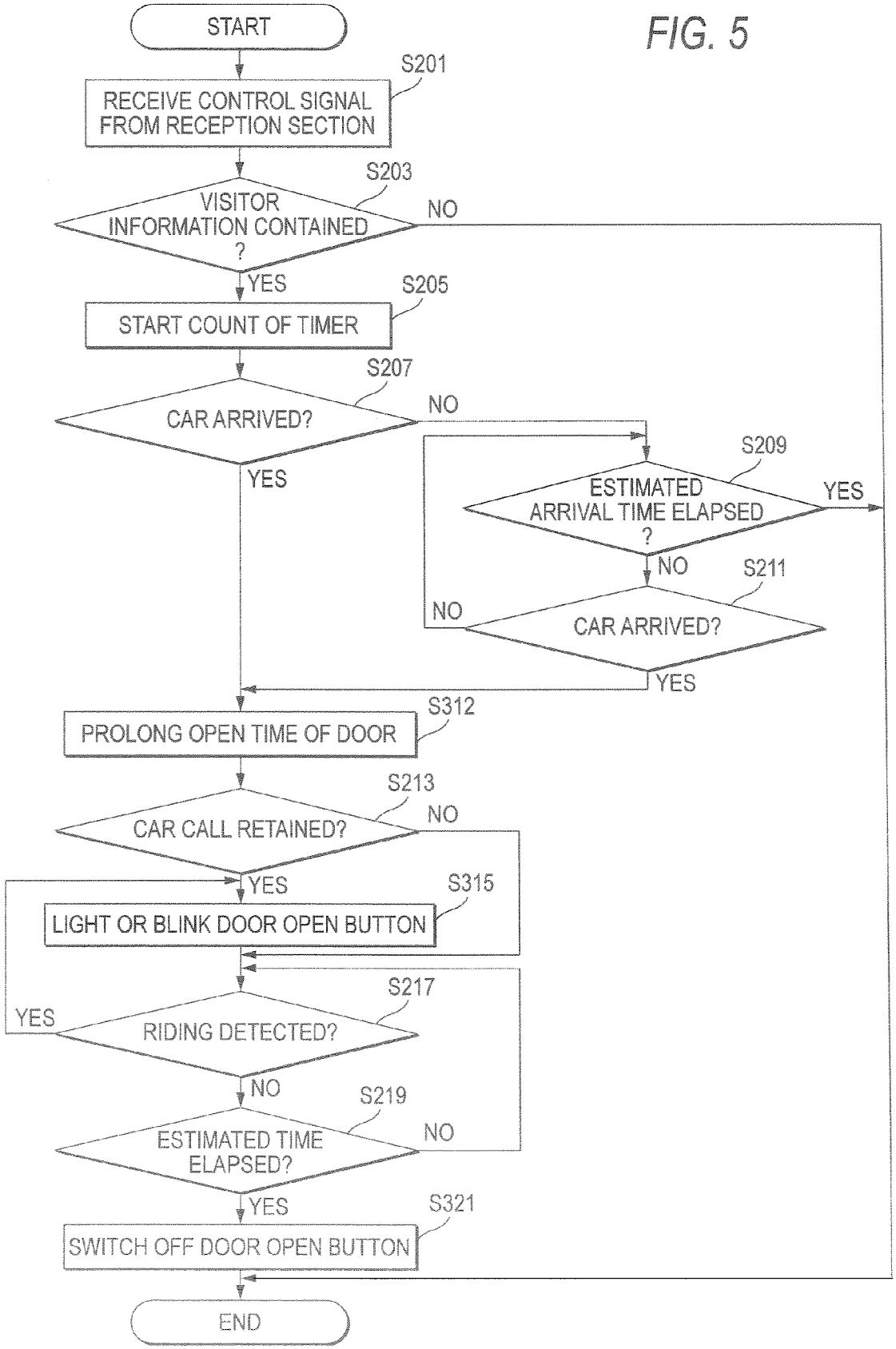
FIG. 5
START
S201
RECEIVE CONTROL SIGNAL FROM RECEPTION SECTION
S203
VISITOR INFORMATION CONTAINED ?
NO
YES
S205
START COUNT OF TIMER
S207
CAR ARRIVED?
NO
YES
S209
ESTIMATED ARRIVAL TIME ELAPSED ?
YES
NO
S211
CAR ARRIVED?
NO
YES
S312
PROLONG OPEN TIME OF DOOR
S213
CAR CALL RETAINED?
NO
YES
S315
LIGHT OR BLINK DOOR OPEN BUTTON
S217
RIDING DETECTED?
YES
NO
S219
ESTIMATED TIME ELAPSED?
NO
YES
S321
SWITCH OFF DOOR OPEN BUTTON
END

ELEVATOR CONTROL SYSTEM

TECHNICAL FIELD

This invention relates to an elevator control system for enhancing the convenience of visitors.

BACKGROUND ART

In a conventional elevator control system as described in patent document 1, a doorway management apparatus includes: an elevator installed in a building; and a release device for releasing locking of an automatic locking entrance door of the building is installed in a room. In the elevator control system further includes entrance floor call registration means for registering a call of a car of the elevator to the floor where the entrance placed in association with the release operation when a release operation of the entrance door with the release device is performed.

Further, the elevator control system includes destination floor registration means for registering the floor where the room of the operated release device exists as the destination floor after responding to the call registration to the entrance floor by the call registration means.

According to the elevator control system, when a visitor calls on a resident in one room and contacts the resident through an interphone, etc., installed in the entrance, the resident operates the release device in his or her room to release the automatic locking entrance door for enabling the visitor to enter the building. The entrance floor call registration means generates a call of the entrance floor (hall call or car call) in association with the release operation and the car stopped at any floor is called to the entrance floor. The visitor goes to the room of the resident using the arriving car.

Further, after the car arrives at the entrance floor in response to the entrance floor call, the destination floor registration means registers the floor of the room where the release operation has been performed (resident's room) as the destination floor, which enables the visitor to go to the floor of the resident's room using the elevator simply by getting into the elevator after the car arrives.

Therefore, if a visitor calls on a resident, the resident can permit the visitor to go to the floor of the resident's room simply by performing operation of unlocking the automatic locking of the entrance door to allow the visitor to enter the building.

Patent document 1: JP-A-H10-95575

DISCLOSURE OF THE INVENTION

Problems to be Solved by the Invention

However the background art described above involves the following problem: when a resident of the building and a visitor use the elevator from the same hall floor, etc., if the resident early uses the elevator, the later coming visitor fails to get into the elevator. In this case, to use the elevators the visitor must return to the automatic locking entrance door and then the entrance door must be released for registering a call.

The invention is intended for solving the problems as described above and it is an object of the invention to provide an elevator control system for preventing a visitor from failing to get into an elevator.

Means for Solving the Problems

An elevator control system according to a first aspect of the invention includes permission means provided at a predetermined distance from an elevator hall for permitting a first passenger to use an elevator and registering a call of the elevator; storage means for storing a predetermined estimated move time value for the first passenger to move from the permission means to the hall; arrival detection means for detecting the elevator arriving at the hall; time count means for starting to count based on permission of the permission means and setting an arrival time value when the arrival detection means detects the elevator arriving at the hall; and notification means for notifying a second passenger in a car or at the hall of a presence of the first passenger, wherein the notification means is activated if the arrival time value is shorter than the estimated move time value.

An elevator control system according to a second aspect of the invention includes permission means provided at a predetermined distance from an elevator hall for permitting a first passenger to use an elevator and registering a call of the elevator; storage means for storing a predetermined estimated move time value for the first passenger to move from the permission means to the hall; arrival detection means for detecting the elevator arriving at the hall; time count means for starting to count based on permission of the permission means and setting an arrival time value when the arrival detection means detects the elevator arriving at the hall; and door open time prolonging means for prolonging the open time of a door of the elevator, wherein the door open time prolonging means is activated if the arrival time value is shorter than the estimated move time value.

An elevator control system according to a third aspect of the invention includes riding detection means for detecting a person getting in the car, wherein, in addition to an activation requirement of the notification means or the door open time prolonging means, the notification means or the door open time prolonging means is activated when the riding detection means detects the second passenger getting in the car.

An elevator control system according to a fourth aspect of the invention includes determination means for determining whether or not the elevator stops on a floor where the first passenger is scheduled to get into the car and a car call in a same direction as the call is registered, wherein, in addition to an activation requirement of the notification means or the door open time prolonging means, the notification means or the door open time prolonging means is activated based on the determination of the determination means that the car call is registered.

In an elevator control system according to a fifth aspect of the invention, an operation of at least one of the notification means and the door open time prolonging means is stopped when an estimated arrival time expires.

ADVANTAGES OF THE INVENTION

According to the first aspect of the invention, the time count means starts to count based on permission of the permission means and sets the arrival time value when the arrival detection means detects the elevator arriving at the hall and if the arrival time value is shorter than the estimated move time value, the notification means notifies the second passenger in the car or at the hall of the presence of the first passenger. Therefore, the visitor of the first passenger can promote preventing the car from moving by a call signal of the second passenger. Accordingly, the elevator control system has the advantage that the first passenger failing to get into the elevator can be remedied.

According to the second aspect of the invention, the time count means starts to count based on permission of the permission means and sets the arrival time value when the arrival detection means detects the elevator arriving at the hall and if the arrival time value is shorter than the estimated move time value, the door open time prolonging means prolongs the time required for opening or closing the door of the elevator. Therefore, the time for the visitor of the first passenger to get into the elevator can be prolonged. Accordingly; the elevator control system has the advantage that the first passenger can be prevented from failing to get into the elevator.

According to the third aspect of the invention, the riding detection means detects the second passenger getting in the car and the notification means or the door open time prolonging means is activated. Therefore, the elevator control system has the advantage that the reliability of preventing the first passenger from failing to get into the elevator is enhanced.

According to the fourth aspect of the invention, the notification means or the door open time prolonging means is activated based on the determination of the determination means that the elevator stops on the floor where the first passenger is scheduled to get into the car and a car call in the same direction as the call is registered. Therefore the elevator control system has the advantage that the reliability of preventing the first passenger from failing to get into the elevator is enhanced.

According to the fifth aspect of the invention the operation of at least one of the notification means and the door open time prolonging means is stopped when the estimated arrival time expires so that the elevator control system has the advantage that the operation of the notification means or the door open time prolonging means can be controlled appropriately.

BRIEF DESCRIPTION OF THE DRAWINGS

FIG. 5 is a flowchart of an elevator control system according to another embodiment.

DESCRIPTION OF REFERENCE NUMERALS

30*c*: Determination and generation section, 30*m*: Storage section, 31: Door control unit, 33: Riding detection section, 34: Arrival detection section, 35: Loudspeaker, 37: Display, 38: Monitor.

BEST MODE FOR CARRYING OUT THE INVENTION

Embodiment 1

Figure 1:
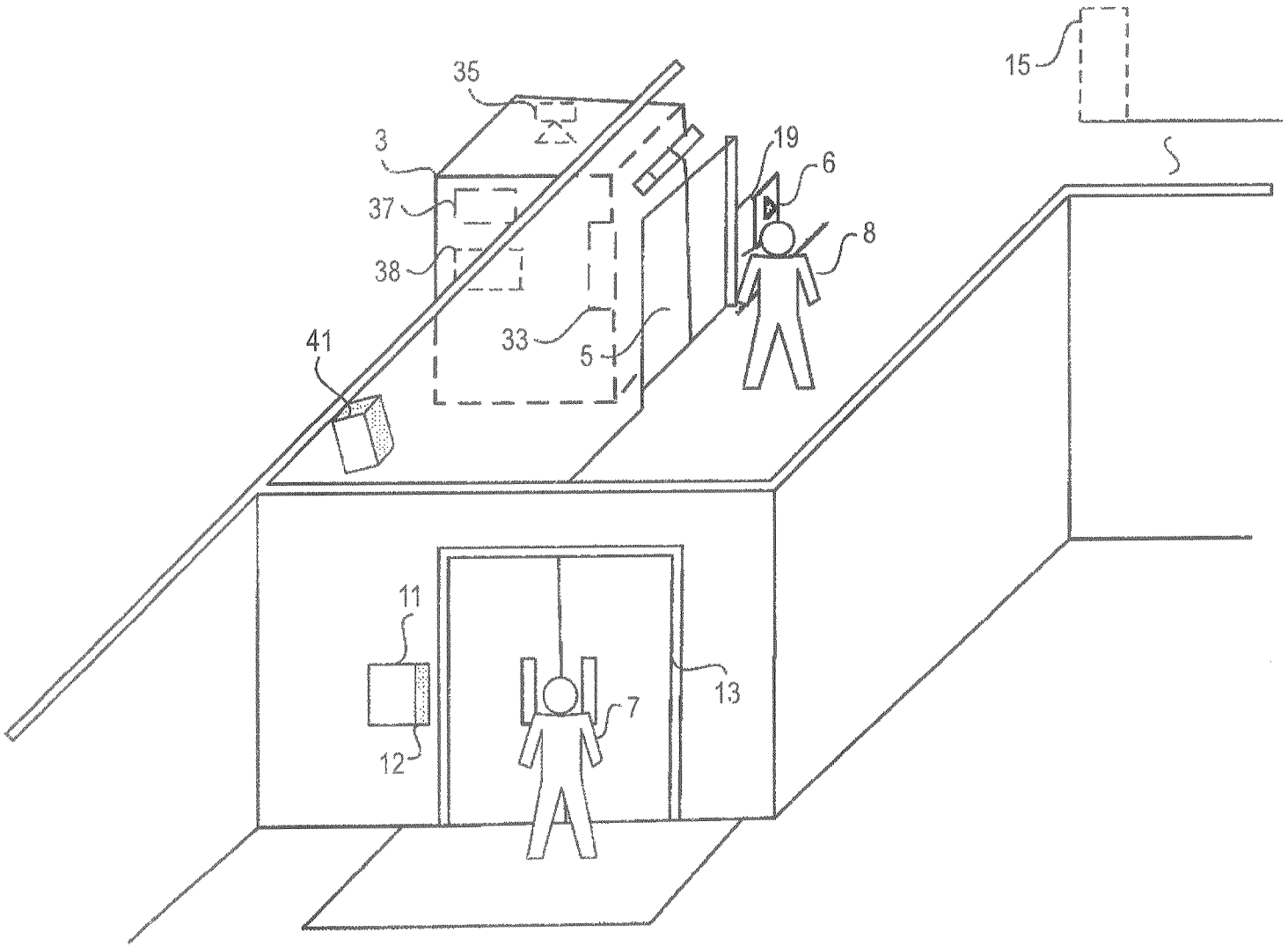
FIG. 1 is a perspective view of the periphery of an elevator showing one embodiment of the invention.
Figure 2:
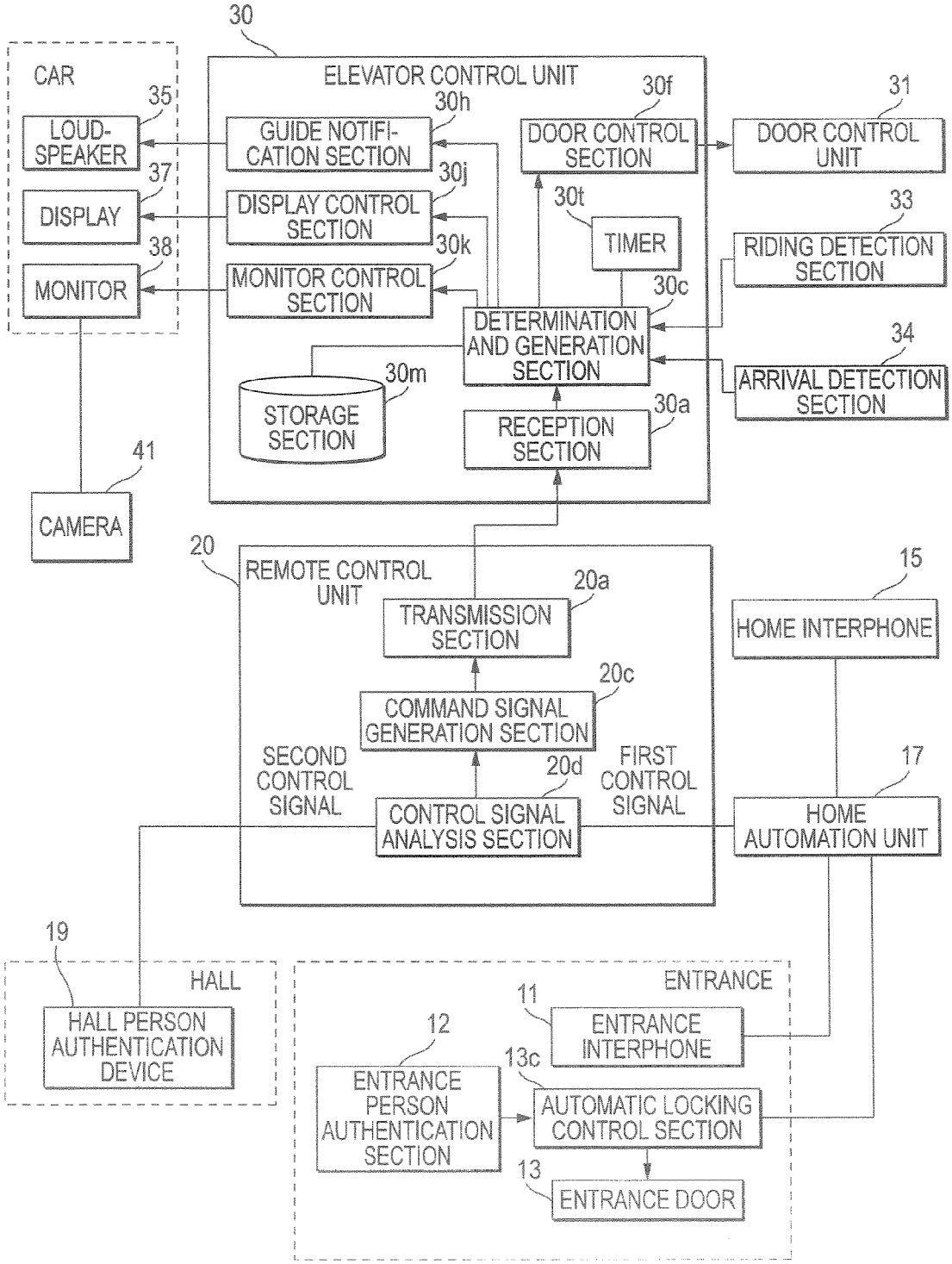
FIG. 2 is a general block diagram of an elevator control system according to one embodiment of the invention.

One embodiment of the invention will be described with reference to FIGS. 1 and 2. FIG. 1 is a perspective view of the periphery of an elevator showing one embodiment, and FIG. 2 is a general block diagram of an elevator control system according to one embodiment.

In FIG. 1, a car 3 of an elevator is installed in a building such as an apartment house as it can move up and down and a home interphone 15 is installed in each home.

The building entrance is provided with an entrance interphone 11 as permission means, an entrance person authentication section 12 for authenticating personal identification based on a card having a person ID number, etc., and generating a first control signal, and an automatic locking entrance door 13 that can be opened and closed by remote operation. The entrance door 13 is adapted to be able to be locked and unlocked by an automatic locking control section 13*c*. The entrance interphone 11 and the automatic locking control section 13*c* are connected through a home automation unit 17 to the home interphone 15 installed in each home, as shown in FIG. 2. Accordingly, a visitor 7 talks to a resident through the home interphone 15 via the home automation unit 17 from the entrance interphone 11 and when the resident permits the visitor to enter the building, the automatic locking control section 13*c* is released through the home automation unit 17 to open the entrance door 13 and a hall call and a car call for the resident to permit use of the elevator can be registered.

In the elevator hall, there are provided a hail call button 6 of the car 3 doors 5 of the hall and the car 3, and a person authentication device 19 for authenticating personal identification based on a card having a person ID number, etc. and generating a second control signal. A camera 41 is provided on a ceiling between the hall and the entrance for picking up an image of the visitor 7, etc. from the entrance. In the car 3, a loudspeaker 35 for producing a predetermined announcement is attached to a ceiling and a display 37 for displaying a predetermined character string, etc. and a monitor 38 for displaying image pick-up information of the camera 41 are fixed onto a side. At least one of the loudspeaker 35, the display 37, and the monitor 38 forms notification means.

In FIG. 2 the elevator control system includes an elevator control unit 30 for controlling the door 5, etc. a remote control unit 20 connected to the elevator control unit 30, and the home automation unit 1 connected to the remote control unit 20.

The remote control unit 20 includes a signal analysis section 20*d* for analyzing either a first or second control signal, a command signal generation section 20*c* for generating a command signal to control the elevator in accordance with the control signal from the signal analysis section 20*d*, and a transmission section 20*a* for transmitting the command signal to the elevator control unit 30.

The elevator control unit 30 is connected to: a riding sensor 33 as riding detection means for detecting a person getting in the car 3 by light, etc. and generating a person detection signal; and an arrival detection section 34 for detecting the car 3 of the elevator arriving at the hall on the first floor by a position detection sensor and generating an arrival signal.

The elevator control unit 30 includes: a storage section 30*m* as storage means for storing the move time required for a visitor to arrive at the hall from the entrance by walking; a reception section 30*a* for receiving the command signal transmitted from the transmission section 20*a*; and a determination and generation section 30*c* for making a predetermined determination based on the command signal, the person detection signal from the riding sensor 33 and the arrival signal from the arrival detection section 34 and generating an operation signal responsive to the determination result.

The determination and generation section 30*c* is connected to: the loudspeaker 35 through a guide notification section 30*h*; the display 37 provided in the car 3 through a display control section 30*j*; the monitor 38 through a monitor control section 30*k*; a timer 30*t* as time count means; and a door control unit 31 through a door control section 30*f* for also controlling the open/closing time of the door 5 of the elevator. The display 37 also has a function of lighting or blinking a door open button for opening the door 5.

Figure 3:
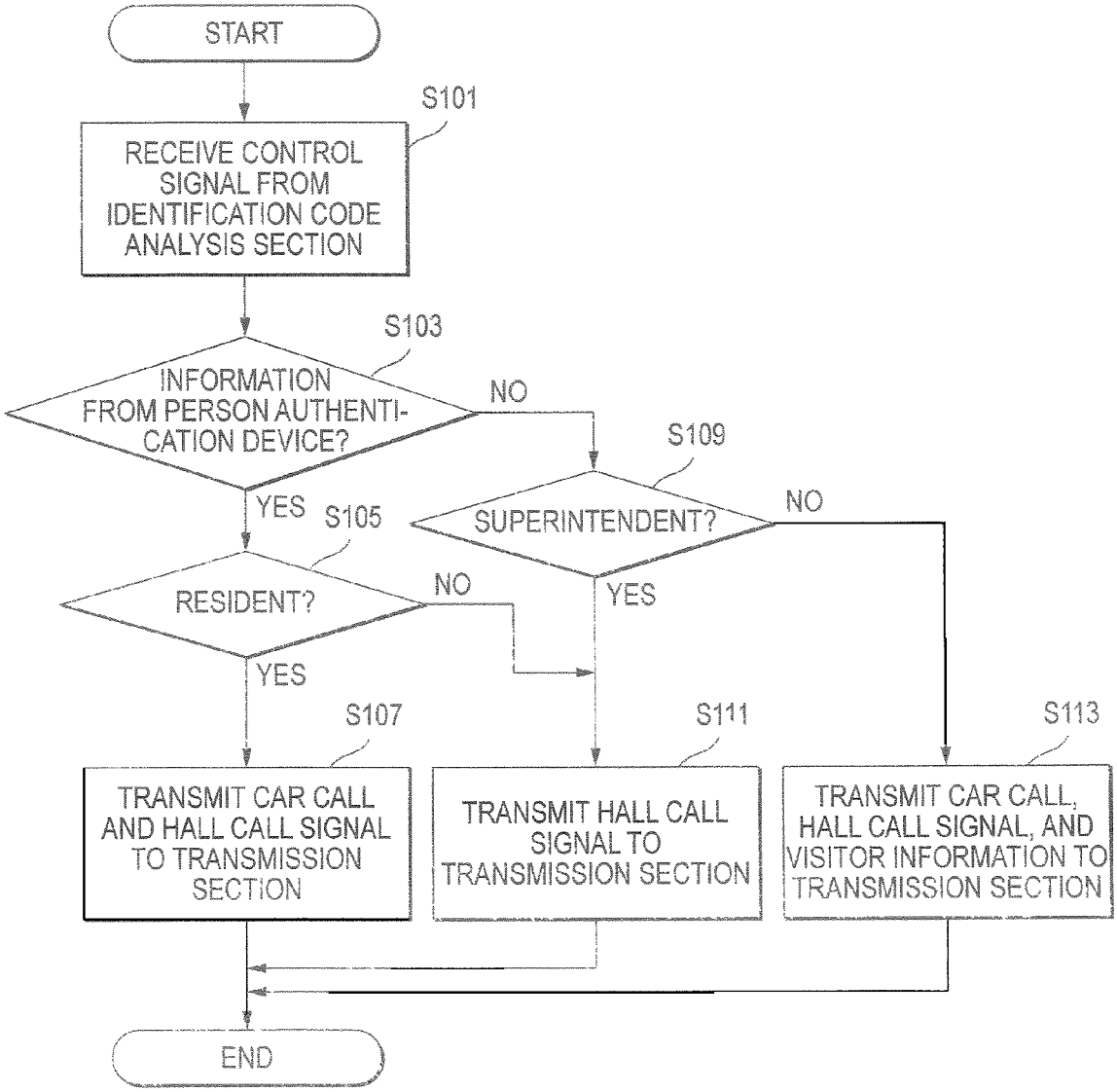
FIG. 3 is a flowchart to show the operation of a remote control unit shown in FIG. 1.
Figure 4:
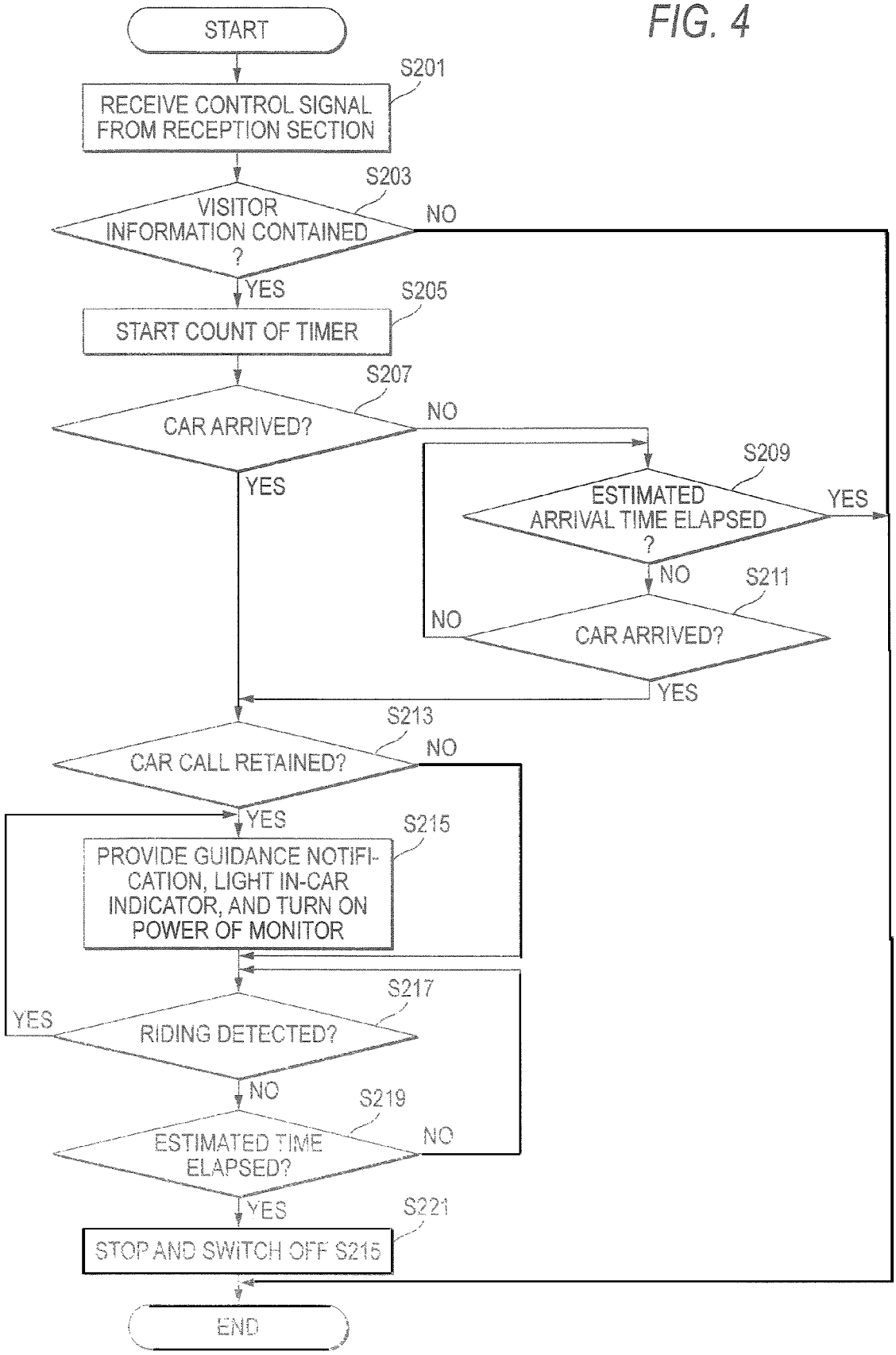
FIG. 4 is a flowchart of the elevator control system shown in FIG. 1.

The operation of the above-described elevator control system will be described with reference to FIGS. 1 to 4. FIG. 3 is a flowchart to show the operation of the remote control unit shown in FIG. 1, and FIG. 4 is a flowchart of the elevator control system shown in FIG. 1. Now, if a passenger 8 inserts a card into the person authentication device 19 at the hall on the bottom floor, a second control signal is transmitted to the control signal analysis section 20*d* together with the identification number, and the command signal generation section 20*c* of the remote control unit 20 receives the second control signal from the control signal analysis section 20*d* (step S101) and determines whether or not the signal is a second control signal from the person authentication device 19 (step S103). If the command signal generation section 20*c* determines that the signal is a second control signal from the person authentication device 19, the command signal generation section 20*c* determines whether the elevator is to be used by a resident or a superintendent according to the identification signal (step S105). If the command signal generation section 20*c* determines that the elevator is to be used by a resident of the apartment house, the command signal generation section 20*c* reads information of the residence floor of the resident contained in the identification signal and transmits a hall call signal to the entrance floor and a car call signal to the residence floor to the transmission section 20*a* as command signals (step S107).

On the other hand, if the command signal generation section 20*c* determines at step S105 that the elevator is to be used by a superintendent, the command signal generation section 20*c* transmits only a hall call signal to the transmission section 20*a* as a command signal (step S111) because information of the residence floor is not contained in the identification signal. If the command signal generation section 20*c* determines at step S103 that the signal is a first control signal from the home automation unit 17 the command signal generation section 20*c* determines whether the elevator is to be used by a visitor or a superintendent according to the identification signal (step S109). If it is determined that the elevator is to be used by a superintendent, above-described step S111 is executed.

At the entrance, a visitor/uses the entrance interphone 11 to talks to a resident using the home interphone 15, and authentication of use of the elevator and use information of the elevator are transmitted from the home interphone 15 through the home automation unit 17 to the control signal analysis section 20*d*.

On the other hand, if the command signal generation section 20*c* determines at step S109 that the elevator is to be used by the visitor 7, the command signal generation section 20*c* reads information contained in the identification signal and indicating the residence floor of the resident on whom the visitor 7 calls and includes visitor information into a command signal where the visitor information indicates that the visitor 7 use a hall call signal to the bottom floor and a car call signal to the resident on whom the visitor 7 calls after the car 3 arrives at the bottom floor, and the command signal is transmitted from the transmission section 20*a* (step S113). The entrance door 13 is unlocked through the home automation unit 17 through the automatic locking control section 13*c* for opening the entrance door 13 to permit the visitor 7 to enter the apartment house. The entrance door 13 is locked after the expiration of a predetermined time.

The determination and generation section 30*c* of the elevator control unit receives a command signal from the reception section 30*a* (step S201) and determines whether or not the command signal contains visitor information of the visitor 7 (step S203). If the determination and generation section 30*c* determines that the command signal contains visitor information, the determination and generation section 30*c* starts to count the tiller 30*t* (step S205).

The determination and generation section 30*c* determines whether or not the car 3 arrives at the bottom floor namely, whether or not the car 3 responding to the hall call received at step S201 arrives based on the presence or absence of an arrival signal from the arrival detection section 34 (step S207). If the determination and generation section 30*c* determines that the car does not arrive, the determination and generation section 30*c* uses the time count value of the timer 30*t* as an arrival time value and determines whether or not the arrival time value is longer than the estimated arrival time value stored in the storage section 30*m* (step S209). If the arrival time value is shorter than the estimated arrival time value, the determination and generation section 30*c* determines whether or not the car 3 arrives at the bottom floor, namely, whether or not the car 3 responding to the hall call received at step S201 arrives based on the presence or absence of an arrival detection signal from the arrival detection section 34 (step S211).

If the arrival time value is longer than the estimated arrival time value at step S209, the processing is terminated.

The determination and generation section 30*c* determines whether or not a car call signal is registered (step S213) and if a car call signal is registered the determination and generation section 30*c* generates an announcement of "Someone will use the elevator. Please wait for a while." from the loudspeaker 35 through the guide notification section 30*h* and displays a message of "Someone will use the elevator. Please wait for a while." on the display 37 through the display control section 30*j*. The determination and generation section 30*c* also turns on power of the monitor 38 and displays video of the camera 41 on the monitor through the monitor control section 30*k*, thereby notification the passenger of a presence of a visitor (step S215).

Accordingly the passenger 8 is prompted to leave the elevator stopped to allow the visitor 7 to get into the car 3.

The determination and generation section 30*c* determines whether or not the visitor 7 getting in the car is detected based on the presence or absence of a person detection signal from the riding sensor 33 (step S217) and determines whether or not the arrival time as the count value of the timer 30*t* is longer than the estimated arrival time step S219). If the arrival time is longer than the estimated arrival time, the determination and generation section 30*c* stops guidance from the guide notification section 30*h* and display of the display 37 at step S215 (step S221).

According to embodiment 1 described above, the elevator control system includes the entrance interphone 11 provided at a predetermined distance from the elevator hall for permitting the visitor 7 to use the elevator and registering a call of the elevator; a storage section 30*r* for storing a predetermined estimated move time value for the visitor 7 to move from the entrance interphone 11 to the hall; the arrival detection section 34 for detecting the elevator arriving at the hall; the timer 30*t* for starting to count based on permission of the entrance interphone 11 and setting the arrival time value when the arrival detection section 34 detects the elevator arriving at the hall; and the loudspeaker 35, etc for notifying the passenger 8 in the car or at the hall of the presence of the visitor 7. If the arrival time value is shorter than the estimated move time value, the loudspeaker 35 is activated. Therefore, the visitor 7 can promote preventing the car from moving by the call signal of the passenger 8. Accordingly, the elevator control system has the advantage that the visitor 7 failing to get into the elevator can be remedied.

Embodiment 2

Another embodiment of the invention will be described. The configuration of an elevator control system of embodiment 2 is the same as that of embodiment 1 and therefore will not be discussed again. The operation of the elevator control system of the embodiment will be described centering on the differences from embodiment 1 with reference to FIGS. 1 to 3 and 5. FIG. 3 is a flowchart of the elevator control system shown in FIG. 1.

At steps S201 to S209, if the arrival time value is shorter than the estimated arrival time value, the determination and generation section 30*c* determines whether or not the car 3 arrives at the bottom floor, namely, whether or not the car 3 responding to the hall call received at step S201 arrives based on the presence or absence of an arrival detection signal from the arrival detection section 34 (step S211). If the determination and generation section 30*c* determines that the car arrives, the determination and generation section 30*c* prolongs the open time of the door 5 through the door control section 30*f* (S312). The determination and generation section 30*c* determines whether or not a car call signal is registered (step S213) and if a car call signal is registered, the determination and generation section 30*c* lights or blinks the door open button through the display control section 30*j* for prompting the passenger in the car 3 to press the door open button (step S315).

The determination and generation section 30*c* determines whether or not the visitor 7 getting in the car is detected based on the presence or absence of a person detection signal from the riding sensor 33 (step S217) and determines whether or not the arrival time as the count value of the timer 30*t* is longer than the estimated arrival time (step S219). If the arrival time is longer than the estimated arrival time, the determination and generation section 30*c* switches off the lighting of the door open button at step S315 (step S321).

According to embodiment 2 described above, the elevator control system includes the entrance interphone 11 provided at a predetermined distance from the elevator hall for permitting the visitor 7 to use the elevator and registering a call of the elevator; a storage section 30*m* for storing a predetermined estimated move time value for the visitor 7 to move from the entrance interphone 11 to the hall; the arrival detection section 34 for detecting the elevator arriving at the hall; the timer 30*t* for starting to count based on permission of the entrance interphone 11 and setting the arrival time value when the arrival detection section 34 detects the elevator arriving at the hall; and the door control section 30*f* for prolonging the time required for opening the door 5 of the elevator. If the arrival time value is shorter than the estimated move time value, the door control section 30*f* is activated. Therefore, the visitor 7 can prolong the time until the car moves by the call signal of the passenger 8. Accordingly, the elevator control system has the advantage that the visitor 7 failing to get into the elevator can be remedied.

INDUSTRIAL APPLICABILITY

The elevator control system according to the invention is suited to call registrations etc., in an entrance at a distance from the elevator hall.

The invention claimed is:

1. An elevator control system comprising:

permission means provided at a predetermined distance from an elevator hall for permitting a first passenger to use an elevator and registering a call of the elevator;

storage means for storing a predetermined estimated move time value for the first passenger to move from said permission means to the hall;

arrival detection means for detecting the elevator arriving at the hall;

time count means for starting to count based on permission of said permission means and setting the arrival time value when said arrival detection means detects the elevator arriving at the hall;

riding detection means for detecting a person getting in the elevator; and notifications means for notifying a second passenger in a car or at the hall of a presence of the first passenger, wherein said notification means is activated if the arrival time value is shorter than the estimated move time value and also if the riding detection means detects the second passenger getting in the elevator.

2. An elevator control system comprising:

permission means provided at a predetermined distance from an elevator hall for permitting a first passenger to use an elevator and registering a call of the elevator;

storage means for storing a predetermined estimated move time value for the first passenger to move from said permission means to the hall;

arrival detection means for detecting the elevator arriving at the hall;

time count means for starting to count based on permission of said permission means and setting the arrival time value when said arrival detection means detects the elevator arriving at the hall;

determination means for determining whether or not the elevator stops on a floor where the first passenger is scheduled to get into a car and a car call in a same direction as the call is registered, and notification means for notifying a second passenger in the car or at the hall of a presence of the first passenger, wherein said notification means is activated if the arrival time value is shorter than the estimated move time value and also if the determination means determines that the car call is registered.

3. The elevator control system according to claim 1, wherein an operation of said notification means is stopped when an estimated time expires.

4. The elevator control system according to claim 2, wherein an operation of said notification means is stopped when an estimated time expires.

* * * * *